US010862208B2

(12) United States Patent
Hasegawa et al.

(10) Patent No.: US 10,862,208 B2
(45) Date of Patent: Dec. 8, 2020

(54) PHASED ARRAY ANTENNA

(71) Applicant: FUJIKURA LTD., Tokyo (JP)

(72) Inventors: Yuta Hasegawa, Sakura (JP); Ning Guan, Sakura (JP)

(73) Assignee: FUJIKURA LTD., Tokyo (JP)

( * ) Notice: Subject to any disclaimer, the term of this patent is extended or adjusted under 35 U.S.C. 154(b) by 362 days.

(21) Appl. No.: 15/771,546

(22) PCT Filed: Sep. 23, 2016

(86) PCT No.: PCT/JP2016/078033
§ 371 (c)(1),
(2) Date: Apr. 27, 2018

(87) PCT Pub. No.: WO2017/077787
PCT Pub. Date: May 11, 2017

(65) Prior Publication Data

US 2018/0342804 A1 Nov. 29, 2018

(30) Foreign Application Priority Data

Nov. 4, 2015 (JP) ..... 2015-216938

(51) Int. Cl.
*H01Q 3/26* (2006.01)
*H01Q 3/42* (2006.01)

(52) U.S. Cl.
CPC ..... *H01Q 3/2682* (2013.01); *H01Q 3/42* (2013.01)

(58) Field of Classification Search
CPC ..... H01Q 3/2682; H01Q 3/42
See application file for complete search history.

(56) References Cited

U.S. PATENT DOCUMENTS 5,510,927 A 4/1996 Noe
6,181,955 B1 * 1/2001 Dartois ..... H01Q 3/2682 342/368

(Continued)

FOREIGN PATENT DOCUMENTS

CN 1735998 A 2/2006
CN 102664684 A 9/2012

(Continued)

OTHER PUBLICATIONS

Decision to Grant a Patent dated Feb. 5, 2019, issued in JP Application No. 2017-552296, (which is counterpart to U.S. Appl. No. 15/776,274), with English machine translation. (4 pages).

(Continued)

*Primary Examiner* — Cassi J Galt
(74) *Attorney, Agent, or Firm* — Westerman, Hattori, Daniels & Adrian, LLP

(57) ABSTRACT

Provided is a phased array antenna in which a delay time of a radio frequency signal supplied to each antenna element is not dependent on frequency. Each feeding circuit (Fi) of the phased array antenna (1) includes: a time delay element (TDi) configured to impart a time delay Δti to a sum signal $V_{IF+LO}(t)$ which is obtained by adding an intermediate frequency signal $V_{IF}(t)$ and a local signal $V_{LO}(t)$; a demultiplexer (DPi) configured to demultiplex a resulting delayed sum signal $V_{IF+LO}(t-\Delta ti)$ so as to provide a delayed intermediate frequency signal $V_{IF}(t-\Delta ti)$ and a delayed local signal $V_{LO}(t-\Delta ti)$; and a transmission mixer (TMXi) configured to multiply the delayed intermediate frequency signal $V_{IF}(t-\Delta ti)$ by the delayed local signal $V_{LO}(t-\Delta ti)$ so as to provide a delayed radio frequency signal $V_{RF}(t-\Delta ti)$, each feeding circuit Fi being configured to supply the delayed radio frequency signal $V_{RF}(t-\Delta ti)$ to a corresponding antenna element (Ai).

3 Claims, 8 Drawing Sheets

(56) References Cited

U.S. PATENT DOCUMENTS

| | | | | |
|---|---|---|---|---|
| 6,448,938 | B1 | 9/2002 | Chiang et al. | |
| 7,043,271 | B1 | 5/2006 | Seto et al. | |
| 9,172,569 | B2 * | 10/2015 | Leenaerts | H01Q 3/2682 |
| 2003/0035183 | A1 | 2/2003 | Seto et al. | |
| 2006/0079290 | A1 | 4/2006 | Seto et al. | |
| 2007/0058975 | A1 | 3/2007 | Sasai et al. | |
| 2012/0256805 | A1 | 10/2012 | Orihashi | |
| 2012/0319746 | A1 | 12/2012 | Hayashi et al. | |
| 2015/0003565 | A1 | 1/2015 | George et al. | |

FOREIGN PATENT DOCUMENTS

| | | | |
|---|---|---|---|
| CN | 102856665 | A | 1/2013 |
| CN | 103401072 | A | 11/2013 |
| EP | 2544301 | A | 1/2013 |
| JP | 2001-85925 | A | 3/2001 |
| JP | 2004-23400 | A | 1/2004 |
| JP | 2007-67802 | A | 3/2007 |
| JP | 2007-165956 | A | 6/2007 |
| JP | 2010-166291 | A | 7/2010 |
| JP | 2014-96637 | A | 5/2014 |
| WO | 2011/078029 | A1 | 6/2011 |
| WO | 2011/108397 | A1 | 9/2011 |

OTHER PUBLICATIONS

Extended (supplementary) European Search Report dated Oct. 19, 2018, issued in related European Application No. 16868250.8. (18 pages).

Ehyaie, D., "Novel Approaches to the Design of Phased Array Antennas", Jan. 1, 2011, retrieved from the Internet; cited in Extended (supplementary) European Search Report dated Aug. 6, 2018. (153 pages).

Extended (supplementary) European Search Report dated Aug. 6, 2018, issued in counterpart European Application No. 16861856.9. (7 pages).

McKenna, T. et al., "Photonic Beamsteering of a Millimeter-Wave Array With 10-Gb/s Data Transmission", IEEE Photonics Technology Letter, Jul. 2014, vol. 26, No. 14, pp. 1407-1410.

Tulchinsky, D. A. et al., "Ultrawide-Band Fiber-Optic Control of a Millimeter-Wave Transmit Beamformer", IEEE Transactions on Microwave Theory and Techniques, Jul. 2001, vol. 49, No. 7, pp. 1248-1253.

Tong, D. et al., "A Novel Multiwavelength Optically Controlled Phased Array Antenna with a Programmable Dispersion Matrix", IEEE Photonics Technology Letters, Jun. 1996, vol. 8, No. 6, pp. 812-814.

* cited by examiner

PHASED ARRAY ANTENNA

TECHNICAL FIELD

The present invention relates to a phased array antenna. The present invention also relates to a feeding circuit which supplies a radio frequency signal to an antenna element in phased array antenna.

BACKGROUND ART

In an attempt to increase capacity of wireless communications, frequency bands used are increasingly in a broader frequency range as well as in a higher frequency region. In recent years, not only a microwave band (not less than 0.3 GHz and not more than 30 GHz) but also a millimeter wave band (not less than 30 GHz and not more than 300 GHz) is used in wireless communications. In particular, 60 GHz band, in which a great attenuation occurs in the atmosphere, is attracting attention as a band in which data leakage is less likely to occur.

An antenna which is used in a wireless communication in 60 GHz band is expected to have a high gain and to operate in a wide frequency band. This is because a great attenuation occurs in 60 GHz band in the atmosphere, as described above. An array antenna is one example of an antenna which has a gain high enough to allow the antenna to be used in 60 GHz band. Note here that "array antenna" refers to an antenna in which a plurality of antenna elements are arranged in an array or in matrix.

In the array antenna, a main beam direction of a radiated electromagnetic wave, which is obtained by superimposing electromagnetic waves radiated from the respective plurality of antenna elements, can be changed by controlling a phase of a radio frequency signal supplied to each of the plurality of antenna elements. The array antenna having such a scanning function is called a phased array antenna, and has been a subject of vigorous research and development.

(a) of FIG. 8 illustrates a typical configuration of a conventional phased array antenna. As illustrated in (a) of FIG. 8, this phased array antenna, which is called an "RF-controlling phased array antenna", imparts a time delay to a radio frequency signal (RF signal) by use of a time delay element and then supplies the radio frequency signal thus delayed to each antenna element.

However, the phased array antenna shown in (a) of FIG. 8 is not suitable for use in a millimeter wave band. This is because it is difficult to impart a highly accurate time delay to a radio frequency signal in a millimeter wave band with use of electrical means such as a time delay element.

Examples of techniques which should be referred to when attempting to achieve a phased array antenna suitable for use in millimeter wave band include the array antennas of Patent Literatures 1 and 2, each of which employs a chromatically dispersive optical fiber as a means for imparting delay. By employing a chromatically dispersive optical fiber as a means for imparting delay, as is done in the array antennas of Patent Literatures 1 and 2, it is possible to impart a highly accurate time delay even to a radio frequency signal in the millimeter wave band.

CITATION LIST

Patent Literature

[Patent Literature 1]
Japanese Patent Application Publication Tokukai No. 2007-165956 (Publication date: Jun. 28, 2007)
[Patent Literature 2]
Japanese Patent Application Publication Tokukai No. 2004-23400 (Publication date: Jan. 22, 2004)

SUMMARY OF INVENTION

Technical Problem

However, in a case where an optical means is employed for imparting delay to a radio frequency signal, as is done in the array antennas of Patent Literatures 1 and 2, there will be an unavoidable increase in cost. This is because in such a case it becomes necessary to use optical components, which are costly in comparison to electronic components. A great increase in cost is to be expected particularly if such an array antenna is to be used in the millimeter wave band, because in such a case it is necessary to use extremely costly components such as a modulator and a photoelectric conversion element.

In view of this, in a case where a phased array antenna usable in a millimeter wave band is to be provided without use of optical means, one option is to employ, in place of a configuration that imparts a time delay to a radio frequency signal, a configuration that delays an intermediate frequency signal or a local signal, each of which has a frequency lower than that of the radio frequency signal. (b) of FIG. 8 is a block diagram illustrating an IF-controlling phased array antenna, which employs a configuration for delaying an intermediate frequency signal. (c) of FIG. 8 is a block diagram illustrating an LO-controlling phased array antenna, which employs a configuration for delaying a local signal.

As illustrated in (b) of FIG. 8, the IF-controlling phased array antenna is configured such that (i) a time delay is imparted to an intermediate frequency signal (IF signal) by use of a time delay element and (ii) a resulting delayed intermediate frequency signal is multiplied by a local signal, by use of a mixer. This provides a delayed radio frequency signal. As illustrated in (c) of FIG. 8, the LO-controlling phased array antenna is configured such that (i) a time delay is imparted to a (1) local signal by use of a time delay element, and (ii) a resulting delayed local signal is multiplied by an intermediate frequency signal, by use of a mixer. This provides a delayed radio frequency signal.

However, in each of the IF-controlling phased array antenna and the LO-controlling phased array antenna, the delay time of the radio frequency signal supplied to each antenna element is dependent on frequency. This creates the new problem that a direction of a main beam of radiated electromagnetic waves changes in accordance with frequency.

In the LO-controlling phased array antenna, the delay time of the radio frequency signal supplied to each antenna element is dependent on frequency for the following reason. The delayed local signal $V_{LO}(t-\Delta t)$ and the intermediate frequency signal $V_{IF}(t)$ are expressed as shown in Formulas (A) and (B), respectively. As such, the radio frequency signal $V_{RF}(t-\Delta t)$ obtained by multiplying these two signals is expressed as shown in Formula (C). Formula (C) shows that the delay time $f_{LO}\times\Delta t/(f_{LO}+f_{IF})$ of the radio frequency signal $V_{RF}(t-\Delta t)$ is dependent on frequencies $f_{LO}$ and $f_{IF}$. In the IF-controlling phased array antenna as well, the delay time of the radio frequency signal supplied to each antenna element is dependent on frequency for a similar reason.

[Math. A]

$$V_{LO} = V_0\cos(2\pi f_{LO}(t - \Delta ti + \theta_{LO})) \quad (A)$$

[Math. B]

$$V_{IF} = V_1\cos(2\pi f_{IF}(t + \theta_{IF})) \quad (B)$$

[Math. C]

$$V_{RF} = A\frac{V_0V_1}{2}\cos\left(2\pi(f_{LO} + f_{IF})\left(t - \frac{f_{LO}}{f_{LO} + f_{IF}}\Delta ti + \frac{f_{LO}\theta_{LO} + f_{IF}\theta_{IF}}{f_{LO} + f_{IF}}\right)\right) \quad (C)$$

The present invention has been made in view of the above problems. An object of the present invention is to provide a phased array antenna in which, in the band in which the phased array antenna is used, a delay time of a radio frequency signal supplied to each antenna element is not dependent on frequency.

Solution to Problem

In order to solve the above problems, a phased array antenna in accordance with an embodiment of the present invention includes: n (n is an integer of 2 or more) antenna elements A1, A2, . . . and An; n feeding circuits F1, F2, . . . and Fn; and a multiplexer configured to generate a sum signal $V_{IF+LO}(t)$ by adding an intermediate frequency signal $V_{IF}(t)$ and a local signal $V_{LO}(t)$, each feeding circuit Fi (i=1, 2, . . . n) including: a time delay element configured to generate a delayed sum signal $V_{IF+LO}(t-\Delta ti)$ by imparting a time delay Δti to the sum signal $V_{IF+LO}(t)$; a demultiplexer configured to generate a delayed intermediate frequency signal $V_{IF}(t-\Delta ti)$ and a delayed local signal $V_{LO}(t-\Delta ti)$ by demultiplexing the delayed sum signal $V_{IF+LO}(t-\Delta ti)$; and a transmission mixer configured to generate a delayed radio frequency signal $V_{RF}(t-\Delta ti)$ by multiplying the delayed intermediate frequency signal $V_{IF}(t-\Delta ti)$ by the delayed local signal $V_{LO}(t-\Delta ti)$, each feeding circuit Fi being configured to supply the delayed radio frequency signal $V_{RF}(t-\Delta ti)$ to a corresponding antenna element Ai.

Advantageous Effects of Invention

An embodiment of the present invention makes it possible to provide a phased array antenna in which the delay time of a radio frequency signal supplied to each antenna element is not dependent on frequency.

DESCRIPTION OF EMBODIMENTS

Embodiment 1

Figure 1:
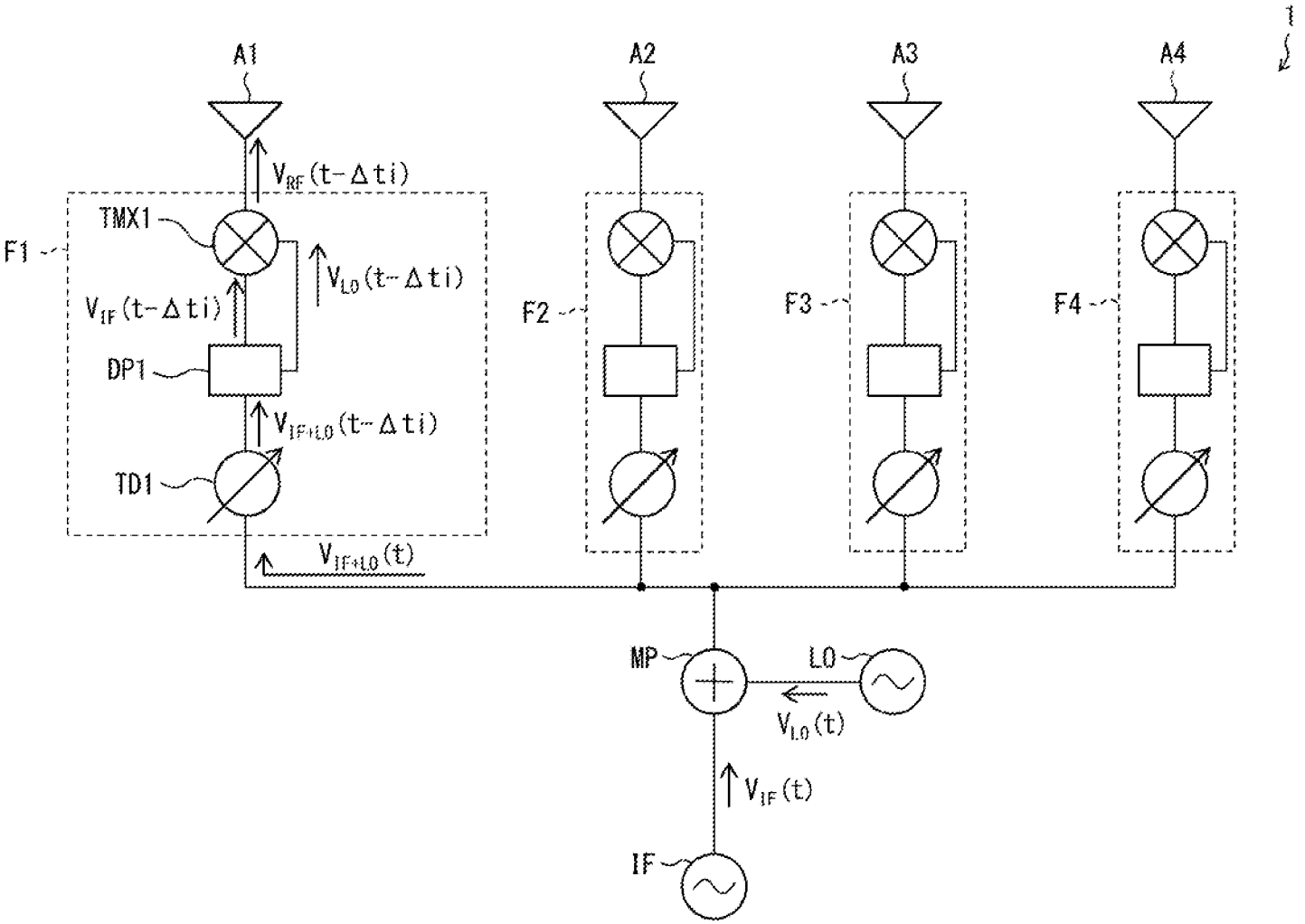
FIG. 1 is a block diagram illustrating a configuration of a phased array antenna in accordance with Embodiment 1 of the present invention.

The following description will discuss, with reference to FIG. 1, a phased array antenna 1 in accordance with Embodiment 1 of the present invention. FIG. 1 is a block diagram illustrating a configuration of the phased array antenna 1.

As illustrated in FIG. 1, the phased array antenna 1 is a transmitting antenna which includes n antenna elements A1, A2, . . . and An; n feeding circuits F1, F2, . . . and Fn; and one multiplexer MP. Note here that n represents any integer not less than 2; FIG. 1 illustrates a configuration where n=4.

The multiplexer MP adds an intermediate frequency signal $V_{IF}(t)$ and a local signal $V_{LO}(t)$ so as to generate a sum signal $V_{IF+LO}(t)$ which equals $V_{IF}(t)+V_{LO}(t)$. The intermediate frequency signal $V_{IF}(t)$, the local signal $V_{LO}(t)$, and the sum signal $V_{IF+LO}(t)$ can be expressed by, for example, the following formulas.

[Math. 1]

$$V_{IF}(t)=V_1\cos(2\pi f_{IF}(t+\theta_{IF})) \quad (1)$$

[Math. 2]

$$V_{L0}(t)=V_0\cos(2\pi f_{LO}(t+\theta_{LO})) \quad (2)$$

[Math. 3]

$$V_{IF+LO}(t)=V_1\cos(2\pi f_{IF}(t+\theta_{IF}))+V_0\cos(2\pi f_{LO}(t+\theta_{LO})) \quad (3)$$

As illustrated in FIG. 1, each feeding circuit Fi (i=1, 2, . . . n) includes a time delay element TDi, a demultiplexer DPi, and a mixer for transmission (hereinafter simply referred to as a "transmission mixer") TMXi. Note that in FIG. 1, reference signs have been provided only for the time delay element TD1, the demultiplexer DP1, and the transmission mixer TMX1 of feeding circuit F1 because each feeding circuit Fi is configurationally identical.

The time delay element TDi generates a delayed sum signal $V_{IF+LO}(t-\Delta ti)$ by imparting a time delay Δti to the sum signal $V_{IF+LO}(t)$. In a case where the sum signal $V_{IF+LO}(t)$ is expressed as in Formula (3), the delayed sum signal $V_{IF+LO}(t-\Delta ti)$ is expressed as shown below. Possible examples of the time delay element TDi include a switched line in which feed lines of differing lengths are switched to in accordance with a desired time delay. Furthermore, as described later, the length of the time delay Δti imparted by the time delay element TDi is set in accordance with the direction of a main beam of radiated electromagnetic waves.

[Math. 4]

$$V_{IF+LO}(t-\Delta ti)=V_1\cos(2\pi f_{IF}(t-\Delta ti+\theta_{IF}))+V_0\cos(2\pi f_{LO}(t-\Delta ti+\theta_{LO})) \quad (4)$$

The demultiplexer DPi generates a delayed intermediate frequency signal $V_{IF}(t-\Delta ti)$ and a delayed local signal $V_{LO}(t-\Delta ti)$ by demultiplexing the delayed sum signal $V_{IF+LO}(t-\Delta ti)$. In a case where the delayed sum signal $V_{IF+LO}(t-\Delta ti)$ is expressed as in Formula (4), the delayed intermediate frequency signal $V_{IF}(t-\Delta ti)$ and the delayed local signal $V_{LO}(t-\Delta ti)$ are expressed as shown below.

[Math. 5]

$$V_{IF}(t-\Delta ti)=V_1\cos(2\pi f_{IF}(t-\Delta ti+\theta_{IF})) \quad (5)$$

[Math. 6]

$$V_{LO}(t-\Delta ti)=V_0\cos(2\pi f_{LO}(t-\Delta ti+\theta_{LO})) \quad (6)$$

The transmission mixer TMXi generates a delayed radio frequency signal $V_{RF}(t-\Delta ti)$ by multiplying the delayed intermediate frequency signal $V_{IF}(t-\Delta ti)$ by the delayed local signal $V_{LO}(t-\Delta ti)$. In a case where the delayed intermediate frequency signal $V_{IF}(t-\Delta ti)$ and the delayed local signal $V_{LO}(t-\Delta ti)$ are expressed as in Formula (5) and Formula (6), the delayed radio frequency signal $V_{RF}(t-\Delta ti)$ is expressed as shown in Formula (7).

[Math. 7]

$$V_{RF}(t)=A\frac{V_0V_1}{2}\cos\left(2\pi(f_{LO}+f_{IF})\left(t-\Delta ti+\frac{f_{LO}\theta_{LO}+f_{IF}\theta_{IF}}{f_{LO}+f_{IF}}\right)\right) \quad (7)$$

The feeding circuit Fi supplies the delayed radio frequency signal $V_{RF}(t-\Delta ti)$ generated by the transmission mixer TMXi to a corresponding antenna element Ai.

The time delay Δti in each feeding circuit Fi can be set in a manner similar to that in a conventional phased array antenna. For example, in a case where the antenna elements A1, A2, . . . and An are arranged in this order along the same straight line, the time delay Δti in each feeding circuit Fi can be set as shown in Formula (8), in accordance with the direction of the main beam of radiated electromagnetic waves. In Formula (8), c represents the speed of light, and di represents a distance between the antenna element A1 and an antenna element Ai. Furthermore, θ is an angle formed by (i) the straight line along which the antenna elements A1, A2, . . . and An are arranged and (ii) an equiphase plane of radiated electromagnetic waves.

[Math. 8]

$$\Delta ti=di\frac{\sin\theta}{c} \quad (8)$$

For example, in a case where an electromagnetic wave in the 60 GHz band (not less than 57 GHz and not more than 66 GHz) is radiated, a distance between adjacent ones of the antenna elements can, for example, be set to ½ of a free space wavelength corresponding to a center frequency of 61.5 GHz, that is, be set to 2.44 mm. In other words, the distance di between the antenna element A1 and the antenna element Ai can be set to 2.44×(i−1) mm. In this configuration, the time delay Δti in each feeding circuit Fi can be set to 5.7×(i−1) ps in order to incline a radiation direction such that the angle θ becomes 45°, the angle θ being formed by (i) the straight line along which the antenna elements A1, A2, . . . and An are arranged and (ii) the equiphase plane of radiated electromagnetic waves.

In order to achieve the phased array antenna 1 in which ±60° beam scanning in the 60 GHz band is possible, the phased array antenna 1 can be configured such that, for example, (i) the antenna elements A1, A2, . . . and An are arranged at intervals of 2.4 mm along the same straight line, and (ii) an intermediate frequency signal $V_{IF}(t)$ and a local signal $V_{LO}(t)$ each having a 9 GHz bandwidth are used. In order to achieve the phased array antenna 1 in which ±45° beam scanning in the 60 GHz band is possible, the phased array antenna 1 can be configured such that, for example, (i) the antenna elements A1, A2, . . . and An are arranged at intervals of 2.6 mm along the same straight line, and (ii) an intermediate frequency signal $V_{IF}(t)$ and a local signal $V_{LO}(t)$ each having a 9 GHz bandwidth are used.

In a case where an electromagnetic wave in the 70 GHz band (not less than 71 GHz and not more than 76 GHz) is radiated, a distance between adjacent ones of the antenna elements can, for example, be set to ½ of a free space wavelength corresponding to a center frequency of 73.5 GHz, that is, be set to 2.04 mm. In other words, the distance di between the antenna element A1 and the antenna element Ai can be set to 2.04×(i−1) mm. In this configuration, the time delay Δti in each feeding circuit Fi can be set to 4.8×(i−1) ps in order to incline a radiation direction such that the angle θ becomes 45°, the angle θ being formed by (i) the straight line along which the antenna elements A1, A2, . . . and An are arranged and (ii) the equiphase plane of radiated electromagnetic waves.

In order to achieve the phased array antenna in which ±60° beam scanning in the 70 GHz band is possible, the phased array antenna can be configured such that, for example, (i) the antenna elements A1, A2, . . . and An are arranged at intervals of 2.1 mm along the same straight line, and (ii) an intermediate frequency signal $V_{IF}(t)$ and a local signal $V_{LO}(t)$ each having a 5 GHz bandwidth are used. In order to achieve the phased array antenna in which ±45° beam scanning in the 70 GHz band is possible, the phased array antenna can be configured such that, for example, (i) the antenna elements A1, A2, . . . and An are arranged at intervals of 2.3 mm along the same straight line, and (ii) an intermediate frequency signal $V_{IF}(t)$ and a local signal $V_{LO}(t)$ each having a 5 GHz bandwidth are used.

A noteworthy point of the phased array antenna 1 is that an amount of time delay in the delayed radio frequency signal $V_{RF}(t-\Delta ti)$ inputted into each antenna element Ai is not dependent on frequency. As such, with the phased array antenna 1, even if the frequency of radiated electromagnetic waves is changed, the electromagnetic waves can be radiated in a constant direction, without a change in the amount of time delay Δti in each feeding circuit Fi.

For example, in a case where the time delay Δti in each feeding circuit Fi is set to be 5.7×(i−1) ps, it is possible to set the angle θ to be 45°, independently of the frequency of radiated electromagnetic waves. In a case where the time delay Δti in each feeding circuit Fi is set to be 4.8×(i−1) ps, it is also possible to set the angle θ to be 45°, independently of the frequency of radiated electromagnetic waves.

Note that a signal source IF of the intermediate frequency signal $V_{IF}(t)$ and a signal source LO of the local signal $V_{LO}(t)$ can each be a component included in the phased array antenna 1, but do not have to be. Furthermore, a control section (not shown) which controls the time delay Δti in each feeding circuit Fi can be a component included in the phased array antenna 1, but does not have to be.

Furthermore, it is possible to use, as a feeding device for a phased array antenna, a device obtained by removing the antenna elements A1, A2, . . . and An from the phased array antenna 1, that is, a device which includes (i) the n feeding circuits F1, F2, . . . and Fn and (ii) one multiplexer MP.

In each feeding circuit Fi, it is also possible to provide, between the demultiplexer DPi and the transmission mixer TMXi, a multiplier which multiplies the frequency of the delayed local signal $V_{LO}(t-\Delta ti)$. In such a configuration, a delayed local signal $V_{LOM}(t-\Delta ti)$ inputted into the transmission mixer TMXi is expressed by Formula (9), and the delayed radio frequency signal $V_{RF}(t-\Delta ti)$ generated by the transmission mixer TMXi is expressed by Formula (10). In these formulas, k represents any integer not less than 2, and can be, for example, 2 or 3. Even with such a configuration, the amount of time delay in the delayed radio frequency signal $V_{RF}(t-\Delta ti)$ is not dependent on frequency.

[Math. 9]

$$V_{LOM}(t-\Delta ti) = V_0\cos(2\pi f_{LO}(t-\Delta ti+\theta_{LO})\times k) \tag{9}$$

[Math. 10]

$$V_{RF}(t-\Delta ti) = A\frac{V_0V_1}{2}\cos\left(2\pi(kf_{LO}+f_{IF})\left(t-\Delta ti+\frac{kf_{LO}\theta_{LO}+f_{IF}\theta_{IF}}{kf_{LO}+f_{IF}}\right)\right) \tag{10}$$

Embodiment 2

Figure 2:
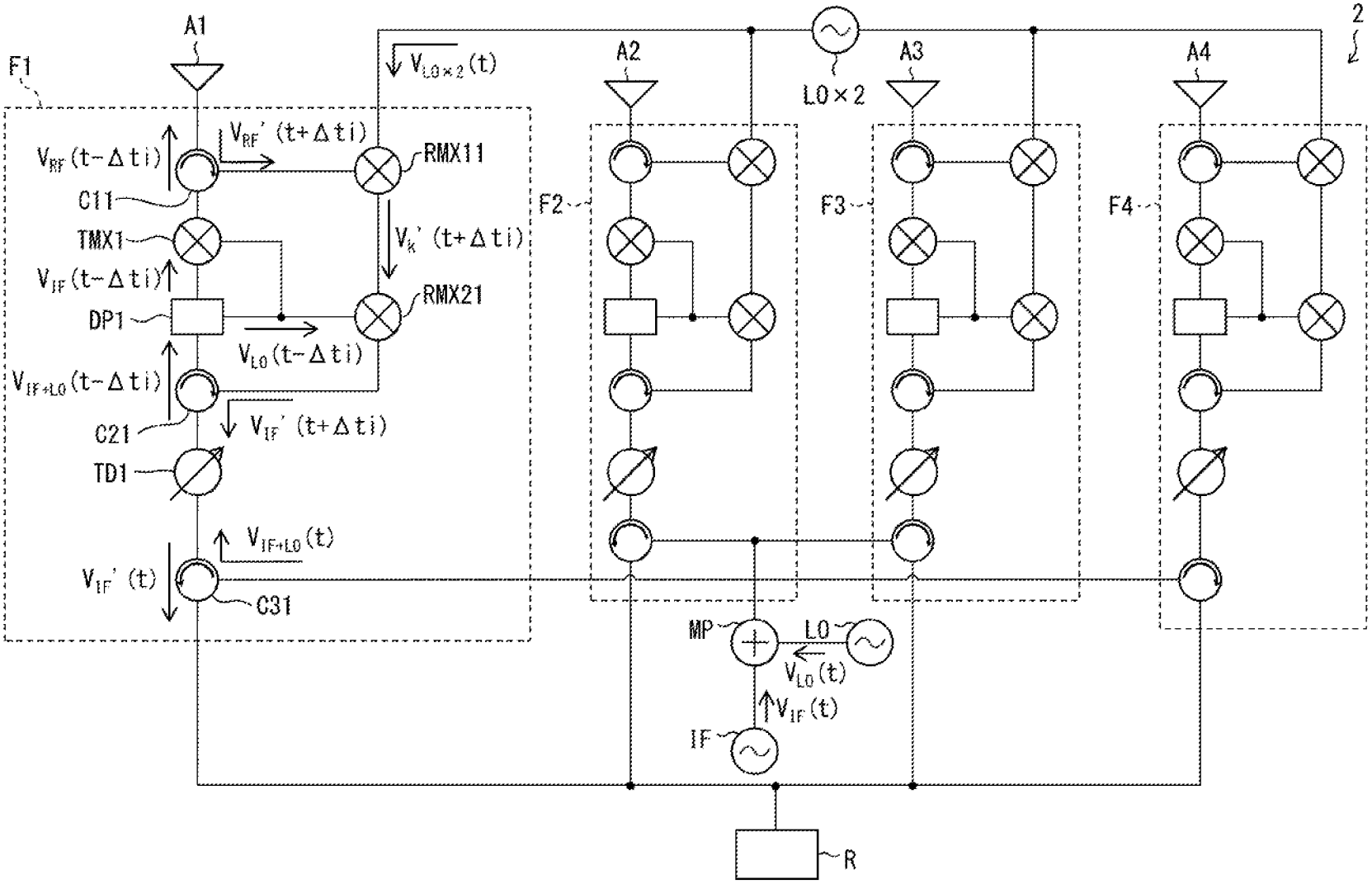
FIG. 2 is a block diagram illustrating a configuration of a phased array antenna in accordance with Embodiment 2 of the present invention.

The following description will discuss, with reference to FIG. 2, a phased array antenna 2 in accordance with Embodiment 2 of the present invention. FIG. 2 is a block diagram illustrating a configuration of the phased array antenna 2.

The phased array antenna 2 is a transmitting and receiving antenna which is obtained by adding components for receiving to the phased array antenna 1, which is a transmitting antenna. As illustrated in FIG. 2, each feeding circuit Fi of the phased array antenna 2 includes, as components for reception, a first mixer for reception (hereinafter simply referred to as a "first reception mixer") RMX1*i* and a second mixer for reception (hereinafter simply referred to as a "second reception mixer") RMX2*i*. Each feeding circuit Fi also includes circulators C1*i* through C3*i*, which are components for enabling both transmitting and receiving. Note that in FIG. 2, reference signs have been provided only for the components of the feeding circuit F1 because each feeding circuit Fi is configurationally identical.

The first reception mixer RMX1*i* generates a difference frequency signal $V_k'(t+\Delta ti')$ by multiplying a radio frequency signal $V_{RF}'(t+\Delta ti)$ by a doubled-frequency local signal $V_{LO\times 2}(t)$. Here, the radio frequency signal $V_{RF}'(t+\Delta ti)$ is a radio frequency signal which has been received by use of a corresponding antenna element Ai. The doubled-frequency local signal $V_{LO\times 2}(t)$ is a local signal whose frequency is twice that of a local signal $V_{LO}(t)$. The radio frequency signal $V_{RF}'(t)$ is expressed as shown in Formula (11), and the difference frequency signal $V_k'(t+\Delta ti')$ is expressed as shown in Formula (12). Note here that $\Delta ti'$ is equal to $\Delta ti\times(f_{LO}+f_{IF})/(f_{LO}-f_{IF})$.

[Math. 11]

$$V_{RF}'(t+\Delta ti)=A\cos(2\pi(kf_{LO}+f_{IF})(t+\Delta ti)) \tag{11}$$

[Math. 12]

$$V_k'(t+\Delta ti)=A_1\cos(2\pi(f_{LO}-f_{IF})t-2\pi(f_{LO}+f_{IF})\Delta ti) \tag{12}$$

The second reception mixer RMX2*i* generates an intermediate frequency signal $V_{IF}'(t+\Delta ti)$ by multiplying the difference frequency signal $V_k'(t+\Delta ti')$ by a delayed local signal $V_{LO}(t-\Delta ti)$. Since the difference frequency signal $V_k(t)$ is expressed as shown in Formula (12), the intermediate frequency signal $V_{IF}'(t+\Delta ti)$ is expressed as shown in Formula (13).

[Math. 13]

$$V_{IF}'(t+\Delta ti)=A_2\cos(2\pi f_{IF}(t+\Delta ti)) \tag{13}$$

The time delay element TDi generates a delayed intermediate frequency signal $V_{IF}'(t)$ by imparting a time delay $\Delta ti$ to the intermediate frequency signal $V_{IF}'(t+\Delta ti)$. Since the intermediate frequency signal $V_{IF}'(t+\Delta ti)$ is expressed as shown in Formula (13), the delayed intermediate frequency signal $V_{IF}'(t)$ is expressed as shown in Formula (14). The delayed intermediate frequency signal $V_{IF}'(t)$ is supplied to a receiving circuit R.

[Math. 14]

$$V_{IF}'(t)=A_2\cos(2\pi f_{IF}(t)) \tag{14}$$

The circulator C1*i* is provided between a transmission mixer TMXi and the antenna element Ai and is connected to the first reception mixer RMX1*i*. The circulator C1*i* supplies, to the antenna element Ai, a delayed radio frequency signal $V_{RF}(t-\Delta ti)$ outputted from the transmission mixer TMXi (operation during transmission). The circulator C1*i* also supplies, to the first reception mixer RMX1*i*, the radio frequency signal $V_{RF}'(t+\Delta ti)$ outputted from the antenna element Ai (operation during reception).

The circulator C2*i* is provided between the time delay element TDi and a demultiplexer DPi and is connected to the second reception mixer MR2*i*. The circulator C2*i* supplies, to the demultiplexer DPi, a delayed sum signal $V_{IF+LO}(t-\Delta ti)$ outputted from the time delay element TDi (operation during transmission). The circulator C2*i* also supplies, to the time delay element TDi, the intermediate frequency signal $V_{IF}'(t+\Delta ti)$ outputted from the second reception mixer MR2*i* (operation during reception).

The circulator C3*i* is provided between a multiplexer MP and the time delay element TDi and is connected to the receiving circuit R. The circulator C3*i* supplies, to the time delay element TDi, a sum signal $V_{IF+LO}(t)$ outputted from the multiplexer MP (operation during transmission). The circulator C3*i* also supplies, to the receiving circuit R, the delayed intermediate frequency signal $V_{IF}'(t)$ outputted from the time delay element TDi (operation during reception).

A noteworthy point of the phased array antenna 2 is that the delayed intermediate frequency signal $V_{IF}'(t)$ obtained from each feeding circuit Fi does not include $\Delta ti$, and each delayed intermediate frequency signal $V_{IF}'(t)$ is an identical signal expressed by Formula (14). This makes it possible to also use the phased array antenna 2 as a highly sensitive receiving antenna.

Note that a signal source IF of an intermediate frequency signal $V_{IF}(t)$, a signal source LO of the local signal $V_{LO}(t)$, and a signal source LO×2 of the doubled-frequency local signal $V_{LO\times 2}(t)$ can each be a component included in the phased array antenna 2, but do not have to be. Furthermore, it is possible to use, as a feeding device for a phased array antenna, a device obtained by removing the antenna elements A1, A2, . . . and An from the phased array antenna 2, that is, a device which includes (i) the n feeding circuits F1, F2, . . . and Fn and (ii) one multiplexer MP.

Embodiment 3

Figure 3:
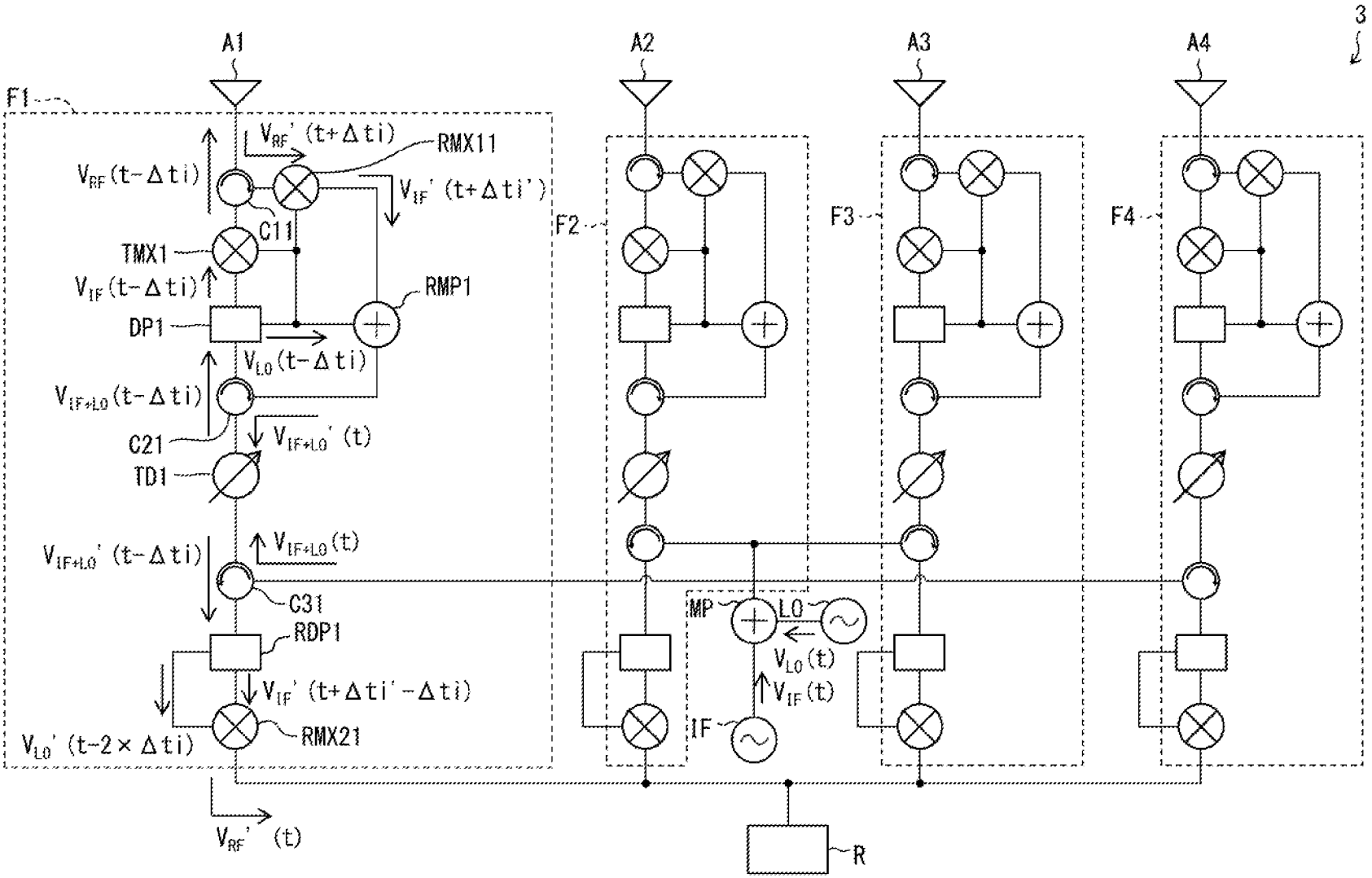
FIG. 3 is a block diagram illustrating a configuration of a phased array antenna in accordance with Embodiment 3 of the present invention.

The following description will discuss, with reference to FIG. 3, a phased array antenna 3 in accordance with Embodiment 3 of the present invention. FIG. 3 is a block diagram illustrating a configuration of the phased array antenna 3.

The phased array antenna 3 is a transmitting and receiving antenna which is obtained by adding components for receiving to the phased array antenna 1, which is a transmitting antenna. As illustrated in FIG. 3, each feeding circuit Fi of the phased array antenna 3 includes, as components for reception, a first reception mixer RMX1*i*, a multiplexer for reception (hereinafter simply referred to as a "reception multiplexer") RMPi, a demultiplexer for reception (hereinafter simply referred to as a "reception demultiplexer") RDPi, and a second reception mixer RMX2*i*. Each feeding circuit Fi also includes circulators C1*i* through C3*i*, which are components for enabling both transmitting and receiving. Note that in FIG. 3, reference signs have been provided only for the components of the feeding circuit F1 because each feeding circuit Fi is configurationally identical.

The first reception mixer RMX1*i* generates an intermediate frequency signal $V_{IF}'(t+\Delta ti')$ by multiplying a radio frequency signal $V_{RF}'(t+\Delta ti)$ by a delayed local signal $V_{LO}(t-\Delta ti)$. Here, the radio frequency signal $V_{RF}'(t+\Delta ti)$ is a radio frequency signal which has been received by use of a corresponding antenna element Ai. The radio frequency signal $V_{RF}'(t+\Delta ti)$ is expressed as shown in Formula (15), and the intermediate frequency signal $V_{IF}'(t+\Delta ti')$ is expressed as shown in Formula (16). Note here that Δti' is equal to $\Delta ti\times(2\times f_{LO}+f_{IF})/f_{IF}$.

[Math. 15]

$$V_{RF}'(t+\Delta ti)=A\cos(2\pi(f_{LO}+f_{IF})(t+\Delta ti)) \quad (15)$$

[Math. 16]

$$V_{IF}'(t+\Delta ti')=A_1\cos(2\pi f_{IF}(t+\Delta ti)+2\pi\times 2f_{LO}\Delta ti) \quad (16)$$

The reception multiplexer RMPi generates a sum signal $V_{IF+LO}'(t)$ by adding the intermediate frequency signal $V_{IF}'(t+\Delta ti')$ and the delayed local signal $V_{LO}(t-\Delta ti)$. Since the intermediate frequency signal $V_{IF}'(t+\Delta ti')$ is expressed as shown in Formula (16), the sum signal $V_{IF+LO}'(t)$ is expressed as shown in Formula (17).

[Math. 17]

$$V_{IF+LO}'(t)=A_1\cos(2\pi f_{IF}(t+\Delta ti)+2\pi\times 2f_{LO}\Delta ti)+A_1'\cos(2\pi f_{LO}(t-\Delta ti)) \quad (17)$$

A time delay element TDi generates a delayed sum signal $V_{IF+LO}'(t-\Delta ti)$ by imparting a time delay Δti to the sum signal $V_{IF+LO}'(t)$. Since the sum signal $V_{IF+LO}'(t)$ is expressed as shown in Formula (17), the delayed sum signal $V_{IF+LO}'(t-\Delta ti)$ is expressed as shown in Formula (18).

[Math. 18]

$$V_{IF+LO}'(t-\Delta ti)=A_1\cos(2\pi f_{IF}t+2\pi\times 2f_{LO}\Delta ti)+A_1'\cos(2\pi f_{LO}(t-\Delta ti)) \quad (18)$$

The reception demultiplexer RDPi generates a delayed intermediate frequency signal $V_{IF}'(t+\Delta ti'-\Delta ti)$ and a doubly delayed local signal $V_{LO}'(t-2\times\Delta ti)$ by demultiplexing the delayed sum signal $V_{IF+LO}'(t-\Delta ti)$. Since the delayed sum signal $V_{IF+LO}'(t-\Delta ti)$ is expressed as shown in Formula (18), the delayed intermediate frequency signal $V_{IF}'(t+\Delta ti'-\Delta ti)$ and the doubly delayed local signal $V_{LO}'(t-2\times\Delta ti)$ are expressed as shown in Formulas (19) and (20), respectively.

[Math. 19]

$$V_{IF}'(t+\Delta ti'-\Delta ti)=A_1\cos(2\pi f_{IF}t+2\pi\times 2f_{LO}\Delta ti) \quad (19)$$

[Math. 20]

$$V_{LO}'(t-2\Delta ti)=A_1'\cos(2\pi f_{LO}(t-2\Delta ti)) \quad (20)$$

The second reception mixer RMX2*i* generates a delayed radio frequency signal $V_{RF}'(t)$ by multiplying the delayed intermediate frequency signal $V_{IF}'(t+\Delta ti'-\Delta ti)$ by the doubly delayed local signal $V_{LO}'(t-2\times\Delta ti)$. Since the delayed intermediate frequency signal $V_{IF}'(t+\Delta ti'-\Delta ti)$ and the doubly delayed local signal $V_{LO}'(t-2\times\Delta ti)$ are expressed as shown in Formulas (19) and (20), the delayed radio frequency signal $V_{RF}'(t)$ is as expressed as shown in Formula (21).

[Math. 21]

$$V_{RF}'(t)=A_2\cos(2\pi(f_{IF}+f_{LO})t) \quad (21)$$

The circulator C1*i* is provided between a transmission mixer TMXi and the antenna element Ai and is connected to the first reception mixer RMX1*i*. The circulator C1*i* supplies, to the antenna element Ai, a delayed radio frequency signal $V_{RF}(t-\Delta ti)$ outputted from the transmission mixer TMXi (operation during transmission). The circulator C1*i* also supplies, to the first reception mixer RMX1*i*, the radio frequency signal $V_{RF}'(t+\Delta ti)$ outputted from the antenna element Ai (operation during reception).

The circulator C2*i* is provided between the time delay element TDi and a demultiplexer DPi and is connected to the reception multiplexer RMPi. The circulator C2*i* supplies, to the demultiplexer DPi, a delayed sum signal $V_{IF+LO}(t-\Delta ti)$ outputted from the time delay element TDi (operation during transmission). The circulator C2*i* also supplies, to the time delay element TDi, the sum signal $V_{IF+LO}'(t)$ outputted from the reception multiplexer RMPi (operation during reception).

The circulator C3*i* is provided between a multiplexer MP and the time delay element TDi and is connected to the reception demultiplexer RDPi. The circulator C3*i* supplies, to the time delay element TDi, a sum signal $V_{IF+LO}(t)$ outputted from the multiplexer MP (operation during transmission). The circulator C3*i* also supplies, to the reception demultiplexer RDPi, the delayed sum signal $V_{IF+LO}'(t-\Delta ti)$ outputted from the time delay element TDi (operation during reception).

A noteworthy point of the phased array antenna 3 is that the delayed radio frequency signal $V_{RF}'(t)$ obtained from each feeding circuit Fi does not include Δti, and each delayed radio frequency signal $V_{RF}'(t)$ is an identical signal expressed by Formula (21). This makes it possible to also use the phased array antenna 3 as a highly sensitive receiving antenna.

Note that a signal source IF of an intermediate frequency signal $V_{IF}(t)$ and a signal source LO of a local signal $V_{LO}(t)$ can each be a component included in the phased array antenna 3, but do not have to be. Furthermore, it is possible to use, as a feeding device for a phased array antenna, a device obtained by removing the antenna elements A1, A2, . . . and An from the phased array antenna 3, that is, a device which includes (i) then feeding circuits F1, F2, . . . and Fn and (ii) one multiplexer MP.

Embodiment 4

Figure 4:
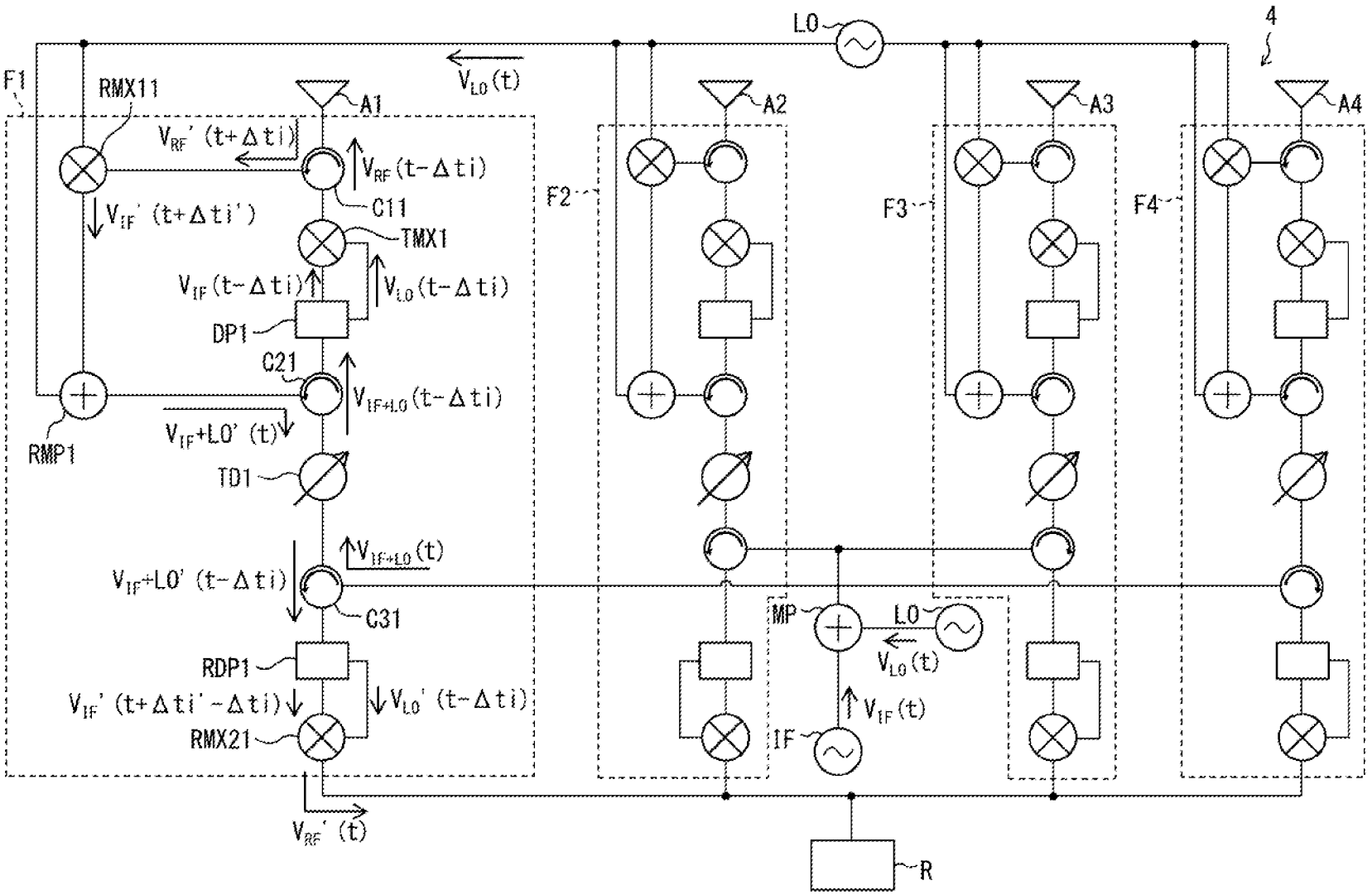
FIG. 4 is a block diagram illustrating a configuration of a phased array antenna in accordance with Embodiment 4 of the present invention.

The following description will discuss, with reference to FIG. 4, a phased array antenna 4 in accordance with Embodiment 4 of the present invention. FIG. 4 is a block diagram illustrating a configuration of the phased array antenna 4.

The phased array antenna 4 is a transmitting and receiving antenna which is obtained by adding components for receiving to the phased array antenna 1, which is a transmitting antenna. As illustrated in FIG. 4, each feeding circuit Fi of the phased array antenna 4 includes, as components for reception, a first reception mixer RMX1*i*, a reception multiplexer RMPi, a reception demultiplexer RDPi, and a second reception mixer RMX2*i*. Each feeding circuit Fi also includes circulators C1*i* through C3*i*, which are components for enabling both transmitting and receiving. Note that in FIG. 4, reference signs have been provided only for the components of the feeding circuit F1 because each feeding circuit Fi is configurationally identical.

The first reception mixer RMX1*i* generates an intermediate frequency signal $V_{IF}'(t+\Delta ti')$ by multiplying a radio frequency signal $V_{RF}'(t+\Delta ti)$ by a local signal $V_{LO}(t)$. Here, the radio frequency signal $V_{RF}'(t+\Delta ti)$ is a radio frequency signal which has been received by use of a corresponding antenna element Ai. A radio frequency signal $V_{RF}'(t)$ is expressed as shown in Formula (22), and an intermediate frequency signal $V_{IF}'(t)$ is expressed as shown in Formula (23). Note here that $\Delta ti'$ is equal to $\Delta ti\times(f_{LO}+f_{IF})/f_{IF}$.

[Math. 22]

$$V_{RF}'(t+\Delta ti)=A\cos(2\pi(f_{LO}+f_{IF})(t+\Delta ti)) \quad (22)$$

[Math. 23]

$$V_{IF}'(t+\Delta ti')=A_1\cos(2\pi f_{IF}(t+\Delta ti)+2\pi f_{LO}\Delta ti) \quad (23)$$

The reception multiplexer RMPi generates a sum signal $V_{IF+LO}'(t)$ by adding the intermediate frequency signal $V_{IF}'(t+\Delta ti)$ and the local signal $V_{LO}(t)$. Since the intermediate frequency signal $V_{IF}'(t+\Delta ti')$ is expressed as shown in Formula (23), the sum signal $V_{IF+LO}'(t)$ is expressed as shown in Formula (24).

[Math. 24]

$$V_{IF+LO}'(t)=A_1\cos(2\pi f_{IF}(t+\Delta ti)+2\pi f_{LO}\Delta ti)+A_1'\cos(2\pi f_{LO}t) \quad (24)$$

The time delay element TDi generates a delayed sum signal $V_{IF+LO}'(t-\Delta ti)$ by imparting a time delay $\Delta ti$ to the sum signal $V_{k+LO}'(t)$. Since the sum signal $V_{IF+LO}'(t)$ is expressed as shown in Formula (24), the delayed sum signal $V_{IF+LO}'(t-\Delta ti)$ is expressed as shown in Formula (25).

[Math. 25]

$$V_{IF+LO}'(t-\Delta ti)=A_1\cos(2\pi f_{IF}t+2\pi f_{LO}\Delta ti)+A_1'\cos(2\pi f_{LO}(t-\Delta ti)) \quad (25)$$

The reception demultiplexer RDPi generates a delayed intermediate frequency signal $V_{IF}'(t+\Delta t'-\Delta ti)$ and a delayed local signal $V_{LO}'(t-\Delta ti)$ by demultiplexing the delayed sum signal $V_{IF+LO}'(t-\Delta ti)$. Since the delayed sum signal $V_{k+LO}'(t-\Delta ti)$ is expressed as shown in Formula (25), the delayed intermediate frequency signal $V_{IF}'(t+\Delta t'-\Delta ti)$ and the delayed local signal $V_{LO}'(t-\Delta ti)$ are expressed as shown in Formulas (26) and (27), respectively.

[Math. 26]

$$V_{IF}'(t+\Delta ti'-\Delta ti)=A_1\cos(2\pi f_{IF}t+2\pi\times f_{LO}\Delta ti) \quad (26)$$

[Math. 27]

$$V_{LO}'(t-\Delta ti)=A_1\cos(2\pi f_{LO}(t-\Delta ti)) \quad (27)$$

The second reception mixer RMX2*i* generates a delayed radio frequency signal $V_{RF}'(t)$ by multiplying the delayed intermediate frequency signal $V_{IF}'(t+\Delta t'-\Delta ti)$ by the delayed local signal $V_{LO}'(t-\Delta ti)$. Since the delayed intermediate frequency signal $V_{IF}'(t+\Delta t'-\Delta ti)$ and the delayed local signal $V_{LO}'(t-\Delta ti)$ are expressed as shown in Formulas (26) and (27), the delayed radio frequency signal $V_{RF}'(t)$ is expressed as shown in Formula (28).

[Math. 28]

$$V_{RF}'(t)=A_2\cos(2\pi(f_{IF}+f_{LO})t) \quad (28)$$

The circulator C1*i* is provided between a transmission mixer TMXi and the antenna element Ai and is connected to the first reception mixer RMX1*i*. The circulator C1*i* supplies, to the antenna element Ai, a delayed radio frequency signal $V_{RF}(t-\Delta ti)$ outputted from the transmission mixer TMXi (operation during transmission). The circulator C1*i* also supplies, to the first reception mixer RMX1*i*, the radio frequency signal $V_{RF}'(t+\Delta ti)$ outputted from the antenna element Ai (operation during reception).

The circulator C2*i* is provided between the time delay element TDi and a demultiplexer DPi and is connected to the reception multiplexer RMPi. The circulator C2*i* supplies, to the demultiplexer DPi, a delayed sum signal $V_{IF+LO}(t-\Delta ti)$ outputted from the time delay element TDi (operation during transmission). The circulator C2*i* also supplies, to the time delay element TDi, the sum signal $V_{IF+LO}'(t)$ outputted from the reception multiplexer RMPi (operation during reception).

The circulator C3*i* is provided between a multiplexer MP and the time delay element TDi and is connected to the reception demultiplexer RDPi. The circulator C3*i* supplies, to the time delay element TDi, a sum signal $V_{IF+LO}(t)$ outputted from the multiplexer MP (operation during transmission). The circulator C3*i* also supplies, to the reception demultiplexer RDPi, the delayed sum signal $V_{IF+LO}'(t-\Delta ti)$ outputted from the time delay element TDi (operation during reception).

A noteworthy point of the phased array antenna 4 is that the delayed radio frequency signal $V_{RF}'(t)$ obtained from each feeding circuit Fi does not include $\Delta ti$, and each delayed radio frequency signal $V_{RF}'(t)$ is an identical signal expressed by Formula (28). This makes it possible to also use the phased array antenna 4 as a highly sensitive receiving antenna.

Note that a signal source IF of an intermediate frequency signal $V_{IF}(t)$ and two signal sources LO of a local signal $V_{LO}(t)$ can each be a component included in the phased array antenna 4, but do not have to be. Furthermore, it is possible to use, as a feeding device for a phased array antenna, a device obtained by removing the antenna elements A1, A2, . . . and An from the phased array antenna 3, that is, a device which includes (i) the n feeding circuits F1, F2, . . . and Fn and (ii) one multiplexer MP.

Embodiment 5

Figure 5:
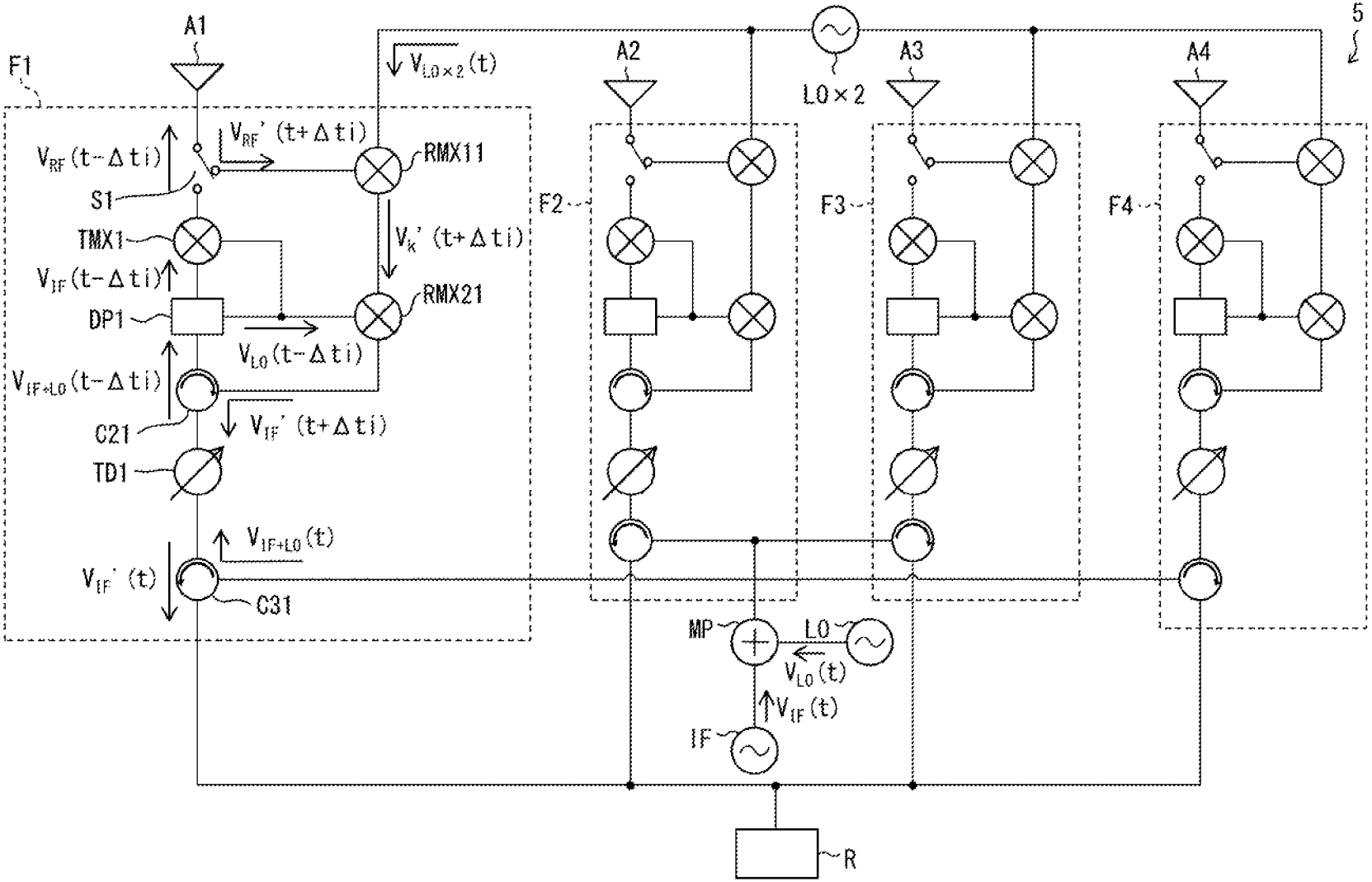
FIG. 5 is a block diagram illustrating a configuration of a phased array antenna in accordance with Embodiment 5 of the present invention.

The following description will discuss, with reference to FIG. 5, a phased array antenna 5 in accordance with Embodiment 5 of the present invention. FIG. 5 is a block diagram illustrating a configuration of the phased array antenna 5.

As illustrated in FIG. 5, the phased array antenna 5 is obtained by replacing the circulator C1*i* of the phased array antenna 2 of Embodiment 2 with a switch Si.

The switch Si is controlled such that, during transmission, a transmission mixer TMXi and an antenna element Ai are connected, and a delayed radio frequency signal $V_{RF}(t-\Delta ti)$ outputted from the transmission mixer TMXi is supplied to the antenna element Ai. Furthermore, the switch Si is controlled such that, during reception, the antenna element Ai is connected to a first reception mixer RMX1*i*, and a radio frequency signal $V_{RF}'(t+\Delta ti)$ outputted from the antenna element Ai is supplied to the first reception mixer RMX1*i*.

Embodiment 6

Figure 6:
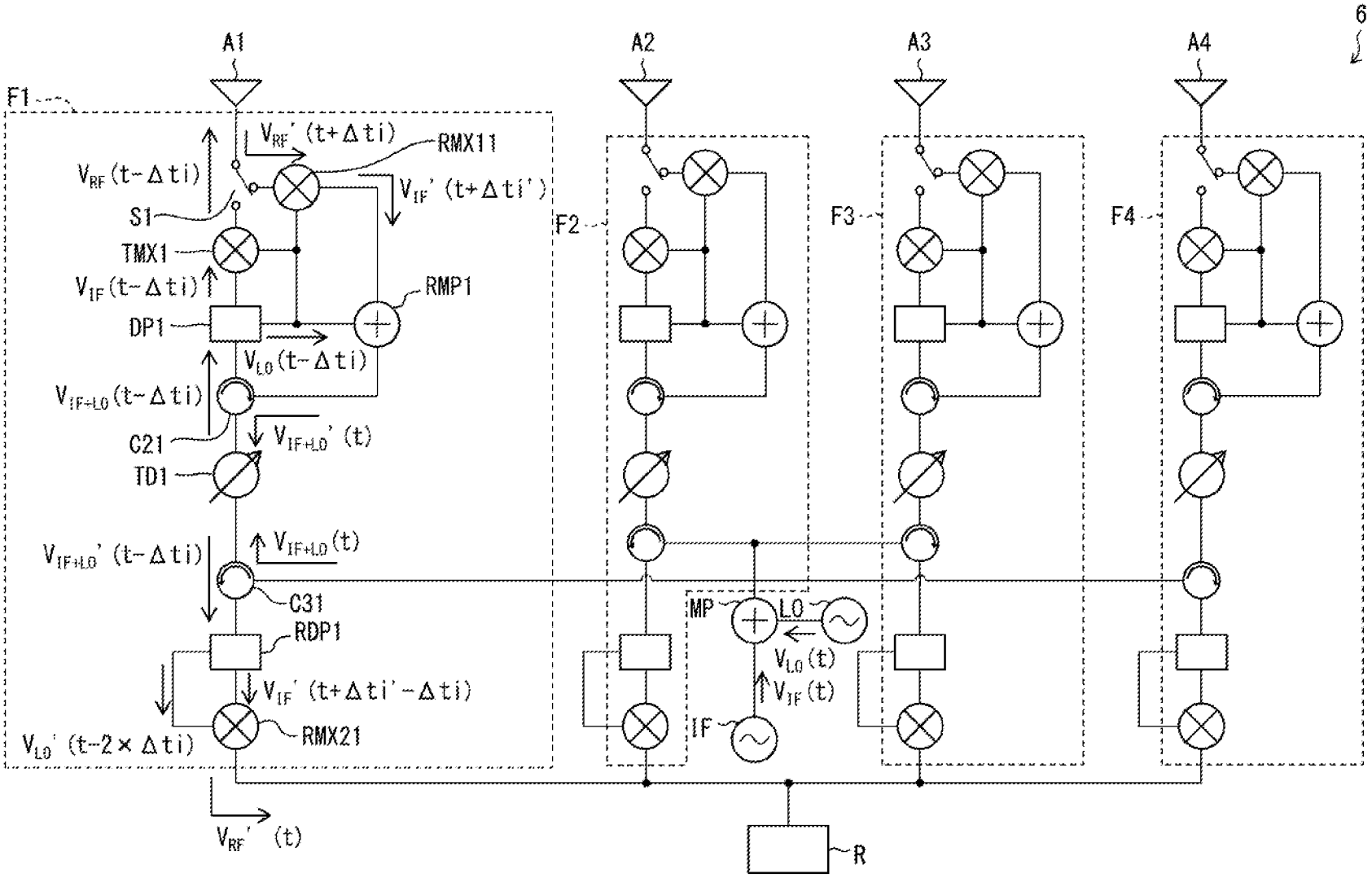
FIG. 6 is a block diagram illustrating a configuration of a phased array antenna in accordance with Embodiment 6 of the present invention.

The following description will discuss, with reference to FIG. 6, a phased array antenna 3 in accordance with Embodiment 6 of the present invention. FIG. 6 is a block diagram illustrating a configuration of the phased array antenna 3.

As illustrated in FIG. 6, the phased array antenna 6 is obtained by replacing the circulator C1*i* of the phased array antenna 3 of Embodiment 3 with a switch Si.

The switch Si is controlled such that, during transmission, a transmission mixer TMXi and an antenna element Ai are connected, and a delayed radio frequency signal $V_{RF}(t-\Delta ti)$ outputted from the transmission mixer TMXi is supplied to the antenna element Ai. Furthermore, the switch Si is controlled such that, during reception, the antenna element Ai is connected to a first reception mixer RMX1*i*, and a radio frequency signal $V_{RF}'(t+\Delta ti)$ outputted from the antenna element Ai is supplied to the first reception mixer RMX1*i*.

Embodiment 7

Figure 7:
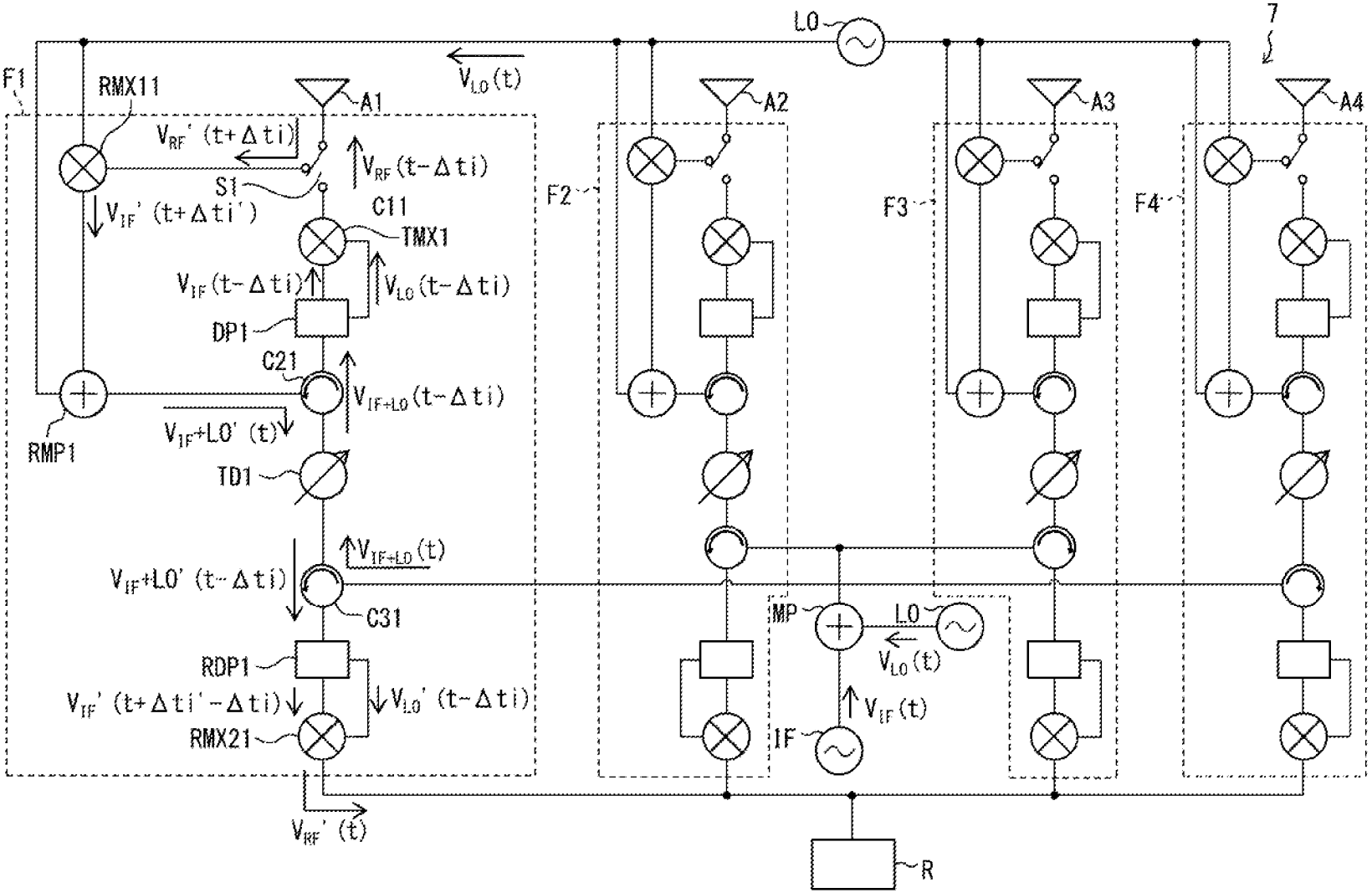
FIG. 7 is a block diagram illustrating a configuration of a phased array antenna in accordance with Embodiment 7 of the present invention.
Figure 8:
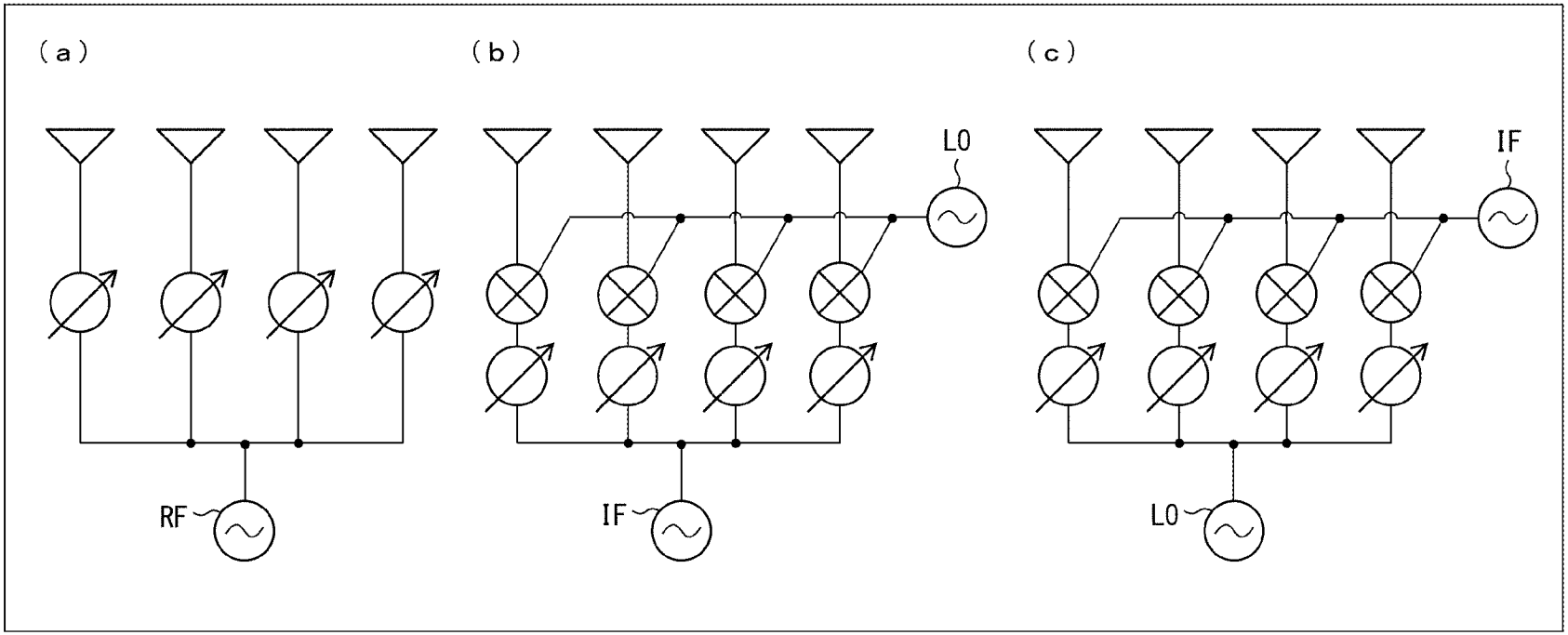
RELATED ART FIG. 8
FIG. 8 is a block diagram illustrating a configuration of a conventional phased array antenna. (a) of FIG. 8 illustrates a configuration of an RF-controlling phased array antenna. (b) of FIG. 8 illustrates a configuration of an IF-controlling phased array antenna.

The following description will discuss, with reference to FIG. 7, a phased array antenna 7 in accordance with Embodiment 7 of the present invention. FIG. 7 is a block diagram illustrating a configuration of the phased array antenna 7.

As illustrated in FIG. 7, the phased array antenna 7 is obtained by replacing the circulator C1*i* of the phased array antenna 4 of Embodiment 4 with a switch Si.

The switch Si is controlled such that, during transmission, a transmission mixer TMXi and an antenna element Ai are connected, and a delayed radio frequency signal $V_{RF}(t-\Delta ti)$ outputted from the transmission mixer TMXi is supplied to the antenna element Ai. Furthermore, the switch Si is controlled such that, during reception, the antenna element Ai is connected to a first reception mixer RMX1*i*, and a radio frequency signal $V_{RF}'(t+\Delta ti)$ outputted from the antenna element Ai is supplied to the first reception mixer RMX1*i*.

[Recap]

A phased array antenna in accordance with the above embodiments of the present invention includes: n (n is an integer of 2 or more) antenna elements A1, A2, . . . and An; n feeding circuits F1, F2, . . . and Fn; and a multiplexer configured to generate a sum signal $V_{IF+LO}(t)$ by adding an intermediate frequency signal $V_{IF}(t)$ and a local signal $V_{LO}(t)$, each feeding circuit Fi (i=1, 2, . . . n) including: a time delay element configured to generate a delayed sum signal $V_{IF+LO}(t-\Delta ti)$ by imparting a time delay Δti to the sum signal $V_{IF+LO}(t)$; a demultiplexer configured to generate a delayed intermediate frequency signal $V_{IF}(t-\Delta ti)$ and a delayed local signal $V_{LO}(t-\Delta ti)$ by demultiplexing the delayed sum signal $V_{IF+LO}(t-\Delta ti)$; and a transmission mixer configured to generate a delayed radio frequency signal $V_{RF}(t-\Delta ti)$ by multiplying the delayed intermediate frequency signal $V_{IF}(t-\Delta ti)$ by the delayed local signal $V_{LO}(t-\Delta ti)$, each feeding circuit Fi being configured to supply the delayed radio frequency signal $V_{RF}(t-\Delta ti)$ to a corresponding antenna element Ai.

The above configuration makes it possible to provide a phased array antenna in which, in the band in which the phased array antenna is used, the time delay of the delayed radio frequency signal $V_{RF}(t-\Delta ti)$ supplied to each antenna element Ai is not dependent on frequency.

The phased array antenna in accordance with the above embodiments can be arranged such that each feeding circuit Fi includes, instead of the transmission mixer: a multiplier configured to generate a delayed local signal $V_{LOM}(t-\Delta ti)$ by multiplying a frequency of the delayed local signal $V_{LO}(t-\Delta ti)$; and a transmission mixer configured to generate a delayed radio frequency signal $V_{RF}(t-\Delta ti)$ by multiplying the delayed intermediate frequency signal $V_{IF}(t-\Delta ti)$ by the delayed local signal $V_{LOM}(t-\Delta ti)$.

The above configuration makes it possible to provide a phased array antenna in which, in the band in which the phased array antenna is used, the time delay of the delayed radio frequency signal $V_{RF}(t-\Delta ti)$ supplied to each antenna element Ai is not dependent on frequency.

The phased array antenna in accordance with the above embodiments can be preferably arranged such that each feeding circuit Fi further includes: a first reception mixer configured to generate a difference frequency signal $V_k'(t+\Delta ti)$ by multiplying (a) a radio frequency signal $V_{RF}'(t+\Delta ti)$ which has been received by use of the corresponding antenna element Ai by (b) a doubled-frequency local signal $V_{LO\times 2}(t)$, whose frequency is twice that of the local signal $V_{LO}(t)$; and a second reception mixer configured to generate an intermediate frequency signal $V_{IF}'(t+\Delta ti)$ by multiplying the difference frequency signal $V_k'(t+\Delta ti)$ by the delayed local signal $V_{LO}(t-\Delta ti)$, and such that each feeding circuit Fi is configured to supply, to a receiving circuit, a delayed intermediate frequency signal $V_{IF}'(t)$ obtained by imparting the time delay Δti to the intermediate frequency signal $V_{IF}'(t+\Delta ti)$ by use of the time delay element.

The above configuration makes it possible to provide a transmitting and receiving phased array antenna in which, in the band in which the phased array antenna is used, the time delay of the delayed radio frequency signal $V_{RF}(t-\Delta ti)$ supplied to each antenna element Ai is not dependent on frequency.

The phased array antenna in accordance with the above embodiments can be preferably arranged such that each feeding circuit Fi further includes: a first reception mixer configured to generate an intermediate frequency signal $V_{IF}'(t+\Delta ti')$ by multiplying (a) a radio frequency signal $V_{RF}'(t+\Delta ti)$ which has been received by use of the corresponding antenna element Ai by (b) the delayed local signal $V_{LO}(t-\Delta ti)$; a reception multiplexer configured to generate a sum signal $V_{IF+LO}'(t)$ by adding the intermediate frequency signal $V_{IF}'(t+\Delta ti')$ and the delayed local signal $V_{LO}(t-\Delta ti)$; a reception demultiplexer configured to generate a delayed intermediate frequency signal $V_{IF}'(t+\Delta ti'-\Delta ti)$ and a doubly delayed local signal $V_{LO}'(t-2\times\Delta ti)$ by demultiplexing a sum signal $V_{IF+LO}'(t-\Delta ti)$, the sum signal $V_{IF+LO}'(t-\Delta ti)$ being obtained by imparting the time delay Δti to the sum signal $V_{IF+LO}'(t)$ by use of the time delay element; and a second reception mixer configured to generate a delayed radio frequency signal $V_{RF}'(t)$ by multiplying the delayed intermediate frequency signal $V_{IF}'(t+\Delta ti'-\Delta ti)$ by the doubly delayed local signal $V_{LO}'(t-2\times\Delta ti)$, and such that each feeding circuit Fi is configured to supply the delayed radio frequency signal $V_{RF}'(t)$ to a receiving circuit.

The above configuration makes it possible to provide a transmitting and receiving phased array antenna in which, in the bandwidth in which the phased array antenna is used, the time delay of the delayed radio frequency signal $V_{RF}(t-\Delta ti)$ supplied to each antenna element Ai is not dependent on frequency.

The phased array antenna in accordance with the above embodiments can be preferably arranged such that each feeding circuit Fi further includes: a first reception mixer configured to generate an intermediate frequency signal $V_{IF}'(t+\Delta ti')$ by multiplying (a) a radio frequency signal $V_{RF}'(t+\Delta ti)$ which has been received by use of the corresponding antenna element Ai by (b) the local signal $V_{LO}(t)$; a reception multiplexer configured to generate a sum signal $V_{IF+LO}'(t)$ by adding the intermediate frequency signal $V_{IF}'(t+\Delta ti')$ and the local signal $V_{LO}(t)$; a reception demultiplexer configured to generate a delayed intermediate frequency signal $V_{IF}'(t+\Delta ti'-\Delta ti)$ and a delayed local signal $V_{LO}'(t-\Delta ti)$ by demultiplexing a delayed sum signal $V_{IF+LO}'(t-\Delta ti)$, the delayed sum signal $V_{IF+LO}'(t-\Delta ti)$ being obtained by imparting the time delay Δti to the sum signal $V_{IF+LO}'(t)$ by use of the time delay element; and a second reception mixer configured to generate a delayed radio frequency signal $V_{RF}'(t)$ by multiplying the delayed intermediate frequency signal $V_{IF}'(t+\Delta ti'-\Delta ti)$ by the delayed local signal $V_{LO}'(t-\Delta ti)$, and such that each feeding circuit Fi is configured to supply the delayed radio frequency signal $V_{RF}'(t)$ to a receiving circuit.

The above configuration makes it possible to provide a transmitting and receiving phased array antenna in which, in the band in which the phased array antenna is used, the time delay of the delayed radio frequency signal $V_{RF}(t-\Delta ti)$ supplied to each antenna element Ai is not dependent on frequency.

A feeding device in accordance with the above embodiments is a feeding device configured to supply a radio frequency signal to each of n (n is an integer of 2 or more) antenna elements A1, A2, . . . and An which are included in a phased array antenna, the feeding device including: n feeding circuits F1, F2, . . . and Fn; and a multiplexer configured to generate a sum signal $V_{IF+LO}(t)$ by adding an intermediate frequency signal $V_{IF}(t)$ and a local signal $V_{LO}(t)$, each feeding circuit Fi (i=1, 2, . . . n) including: a time delay element configured to generate a delayed sum signal $V_{IF+LO}(t-\Delta ti)$ by imparting a time delay Δti to the sum signal $V_{IF+LO}(t)$; a demultiplexer configured to generate a delayed intermediate frequency signal $V_{IF}(t-\Delta ti)$ and a delayed local signal $V_{LO}(t-\Delta ti)$ by demultiplexing the delayed sum signal $V_{IF+LO}(t-\Delta ti)$; and a transmission mixer configured to generate a delayed radio frequency signal $V_{RF}(t-\Delta ti)$ by multiplying the delayed intermediate frequency signal $V_{IF}(t-\Delta ti)$ by the delayed local signal $V_{LO}(t-\Delta ti)$, each feeding circuit Fi being configured to supply the delayed radio frequency signal $V_{RF}(t-\Delta ti)$ to a corresponding antenna element Ai.

The above configuration makes it possible to provide a phased array antenna in which, in the band in which the phased array antenna is used, the time delay of the delayed radio frequency signal $V_{RF}(t-\Delta ti)$ supplied to each antenna element Ai is not dependent on frequency.

ADDITIONAL MATTERS

The present invention is not limited to the description of the embodiments or variations above, but may be altered within the scope of the claims. The present invention also encompasses, in its technical scope, any embodiment derived from an appropriate combination of technical means disclosed in differing embodiments or variations.

REFERENCE SIGNS LIST

1, 2, 3, and 4 Phased array antenna
Ai Antenna element
Fi Feeding circuit
MP Multiplexer
TDi Time delay element
DPi Demultiplexer
TMXi Transmission mixer

The invention claimed is:

1. A phased array antenna comprising:
n (n is an integer of 2 or more) antenna elements A1, A2, . . . and An;
n feeding circuits F1, F2, . . . and Fn; and
a multiplexer configured to generate a sum signal $V_{IF+LO}(t)$ by adding an intermediate frequency signal $V_{IF}(t)$ and a local signal $V_{LO}(t)$,
each feeding circuit Fi (i=1, 2, . . . n) including:
a time delay element configured to generate a delayed sum signal $V_{IF+LO}(t-\Delta ti)$ by imparting a time delay Δti to the sum signal $V_{IF+LO}(t)$;
a demultiplexer configured to generate a delayed intermediate frequency signal $V_{IF}(t-\Delta ti)$ and a delayed local signal $V_{LO}(t-\Delta ti)$ by demultiplexing the delayed sum signal $V_{IF+LO}(t-\Delta ti)$; and
a transmission mixer configured to generate a delayed radio frequency signal $V_{RF}(t-\Delta ti)$ by multiplying the delayed intermediate frequency signal $V_{IF}(t-\Delta ti)$ by the delayed local signal $V_{LO}(t-\Delta ti)$,
each feeding circuit Fi being configured to supply the delayed radio frequency signal $V_{RF}(t-\Delta ti)$ to a corresponding antenna element Ai,
wherein each feeding circuit Fi further includes:
a first reception mixer configured to generate a difference frequency signal $V_k'(t+\Delta ti)$ by multiplying (a) a radio frequency signal $V_{RF}'(t+\Delta ti)$ which has been received by use of the corresponding antenna element Ai by (b) a doubled-frequency local signal $V_{LO\times 2}(t)$, whose frequency is twice that of the local signal $V_{LO}(t)$; and
a second reception mixer configured to generate an intermediate frequency signal $V_{IF}'(t+\Delta ti)$ by multiplying the difference frequency signal $V_k'(t+\Delta ti)$ by the delayed local signal $V_{LO}(t-\Delta ti)$, and
wherein each feeding circuit Fi is configured to supply, to a receiving circuit, a delayed intermediate frequency signal $V_{IF}'(t)$ obtained by imparting the time delay Δti to the intermediate frequency signal $V_{IF}'(t+\Delta ti)$ by use of the time delay element.

2. A phased array antenna comprising:
n (n is an integer of 2 or more) antenna elements A1, A2, . . . and An;
n feeding circuits F1, F2, . . . and Fn; and
a multiplexer configured to generate a sum signal $V_{IF+LO}(t)$ by adding an intermediate frequency signal $V_{IF}(t)$ and a local signal $V_{LO}(t)$,
each feeding circuit Fi (i=1, 2, . . . n) including:
a time delay element configured to generate a delayed sum signal $V_{IF+LO}(t-\Delta ti)$ by imparting a time delay Δti to the sum signal $V_{IF+LO}(t)$;
a demultiplexer configured to generate a delayed intermediate frequency signal $V_{IF}(t-\Delta ti)$ and a delayed local signal $V_{LO}(t-\Delta ti)$ by demultiplexing the delayed sum signal $V_{IF+LO}(t-\Delta ti)$; and a transmission mixer configured to generate a delayed radio frequency signal $V_{RF}(t-\Delta ti)$ by multiplying the delayed intermediate frequency signal $V_{IF}(t-\Delta ti)$ by the delayed local signal $V_{LO}(t-\Delta ti)$, each feeding circuit Fi being configured to supply the delayed radio frequency signal $V_{RF}(t-\Delta ti)$ to a corresponding antenna element Ai, wherein each feeding circuit Fi further includes:

a first reception mixer configured to generate an intermediate frequency signal $V_{IF}'(t+\Delta ti')$ by multiplying (a) a radio frequency signal $V_{RF}'(t+\Delta ti)$ which has been received by use of the corresponding antenna element Ai by (b) the delayed local signal $V_{LO}(t-\Delta ti)$;

a reception multiplexer configured to generate a sum signal $V_{IF+LO}'(t)$ by adding the intermediate frequency signal $V_{IF}'(t+\Delta ti')$ and the delayed local signal $V_{LO}(t-\Delta ti)$;

a reception demultiplexer configured to generate a delayed intermediate frequency signal $V_{IF}'(t+\Delta ti'-\Delta ti)$ and a doubly delayed local signal $V_{LO}'(t-2\times\Delta ti)$ by demultiplexing a sum signal $V_{IFF+LO}'(t-\Delta ti)$, the sum signal $V_{IFF+LO}'(t-\Delta ti)$ being obtained by imparting the time delay $\Delta ti$ to the sum signal $V_{IF+LO}'(t)$ by use of the time delay element; and a second reception mixer configured to generate a delayed radio frequency signal $V_{RF}'(t)$ by multiplying the delayed intermediate frequency signal $V_{IF}'(t+\Delta ti'-\Delta ti)$ by the doubly delayed local signal $V_{LO}'(t-2\times\Delta ti)$, and wherein each feeding circuit Fi is configured to supply the delayed radio frequency signal $V_{RF}'(t)$ to a receiving circuit.

3. A phased array antenna comprising:

n (n is an integer of 2 or more) antenna elements A1, A2, . . . and An;

n feeding circuits F1, F2, . . . and Fn; and a multiplexer configured to generate a sum signal $V_{IF+LO}(t)$ by adding an intermediate frequency signal $V_{IF}(t)$ and a local signal $V_{LO}(t)$, each feeding circuit Fi (i=1, 2, . . . n) including:

a time delay element configured to generate a delayed sum signal $V_{IF+LO}(t-\Delta ti)$ by imparting a time delay $\Delta ti$ to the sum signal $V_{IF+LO}(t)$;

a demultiplexer configured to generate a delayed intermediate frequency signal $V_{IF}(t-\Delta ti)$ and a delayed local signal $V_{LO}(t-\Delta ti)$ by demultiplexing the delayed sum signal $V_{IF+LO}(t-\Delta ti)$; and a transmission mixer configured to generate a delayed radio frequency signal $V_{RF}(t-\Delta ti)$ by multiplying the delayed intermediate frequency signal $V_{IF}(t-\Delta ti)$ by the delayed local signal $V_{LO}(t-\Delta ti)$, each feeding circuit Fi being configured to supply the delayed radio frequency signal $V_{RF}(t-\Delta ti)$ to a corresponding antenna element Ai, wherein each feeding circuit Fi further includes:

a first reception mixer configured to generate an intermediate frequency signal $V_{IF}'(t+\Delta ti')$ by multiplying (a) a radio frequency signal $V_{RF}'(t+\Delta ti)$ which has been received by use of the corresponding antenna element Ai by (b) the local signal $V_{LO}(t)$;

a reception multiplexer configured to generate a sum signal $V_{IF+LO}'(t)$ by adding the intermediate frequency signal $V_{IF}'(t+\Delta ti')$ and the local signal $V_{LO}(t)$;

a reception demultiplexer configured to generate a delayed intermediate frequency signal $V_{IF}'(t+\Delta ti'-\Delta ti)$ and a delayed local signal $V_{LO}'(t-\Delta ti)$ by demultiplexing a delayed sum signal $V_{IF+LO}'(t-\Delta ti)$, the delayed sum signal $V_{IF+LO}'(t-\Delta ti)$ being obtained by imparting the time delay $\Delta ti$ to the sum signal $V_{IF+LO}'(t)$ by use of the time delay element; and a second reception mixer configured to generate a delayed radio frequency signal $V_{RF}'(t)$ by multiplying the delayed intermediate frequency signal $V_{IF}'(t+\Delta ti'-\Delta ti)$ by the delayed local signal $V_{LO}'(t-\Delta ti)$, and wherein each feeding circuit Fi is configured to supply the delayed radio frequency signal $V_{RF}'(t)$ to a receiving circuit.

* * * * *